United States Patent [19]

Hafner

[11] 4,203,577

[45] May 20, 1980

[54] CAR JACKS

[75] Inventor: Franz X. Hafner, Wurmlingen, Fed. Rep. of Germany

[73] Assignee: E. A. Storz GmbH & Co. KG, Tuttlingen, Fed. Rep. of Germany

[21] Appl. No.: 959,837

[22] Filed: Nov. 13, 1978

[30] Foreign Application Priority Data

Nov. 16, 1977 [DE] Fed. Rep. of Germany ..... 2751202

[51] Int. Cl.[2] ..... B66F 3/36

[52] U.S. Cl. ..... 254/100; 254/DIG. 1

[58] Field of Search ..... 254/DIG. 1, 98–103

[56] References Cited

U.S. PATENT DOCUMENTS

| | | | |
|---|---|---|---|
| 789,071 | 5/1905 | Schroer | 254/DIG. 1 |
| 1,192,611 | 7/1916 | Field | 254/DIG. 1 |
| 1,519,946 | 12/1924 | Williams | 254/101 |

FOREIGN PATENT DOCUMENTS 7429205 11/1974 Fed. Rep. of Germany .

*Primary Examiner*—Robert C. Watson

*Attorney, Agent, or Firm*—Lawrence E. Laubscher

[57] ABSTRACT

A car jack comprises a stand column supported on a base, a carrier arm having pivotally mounted thereon an insertion shaft, and a threaded spindle mounted pivotally but axially immovably on the stand column. A threaded nut is guided on the spindle for raising and lowering the carrier arm, which bears against a surface of the stand column or threaded nut when raised beyond a certain lifting position. The base is arranged, when the insertion shaft is inserted into a socket of a vehicle body, to bear on a supporting surface at the side which faces away from the carrier arm at a radial distance relative to the axis of the stand column.

18 Claims, 12 Drawing Figures

Fig. 2
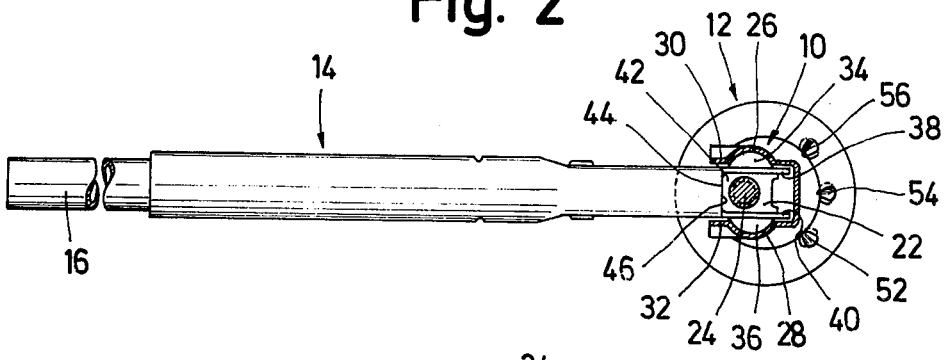
Fig. 3
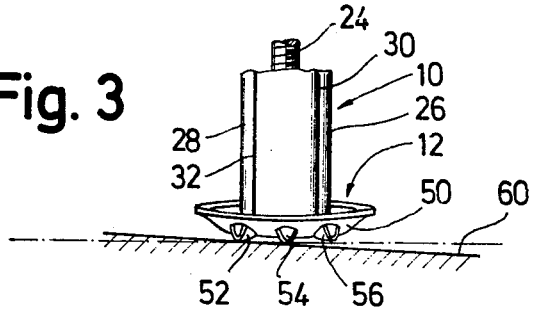
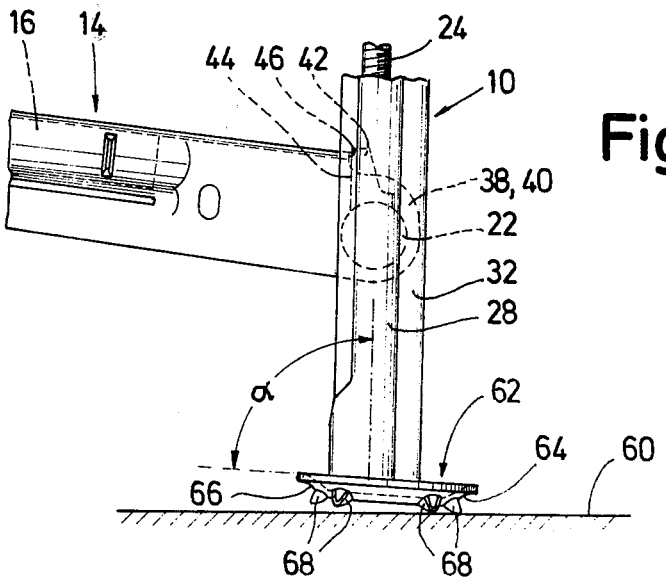
Fig. 4

CAR JACKS

BRIEF DESCRIPTION OF THE PRIOR ART

The invention relates to car jacks.

As known, when a passenger motor car is raised, its body executes a movement approximating an upward directed circular trajectory. Therefore, in order to ensure that in the raised position of the vehicle the stand column of the jack assumes a relatively stable position in relation to its positioning surface, it has to be brought at the beginning of the lifting operation into an obliquely oriented position in such a manner, that it can straighten itself up during the raising operation, to reach finally an approximately vertical position corresponding to the raised position of the vehicle body required e.g. for the execution of a wheel change.

If under these conditions the supporting surface for the car jack is inclined in the direction of the vehicle to be raised, then a moment of force generated by the vehicle comes to act upon the car jack, tending to draw the latter together with the stand column in the direction of the car body. Under the action of this moment of force the carrier arm with its abutting surface is applied under pressure against the bearing surface of the stand column, so that the latter is stably held on the supporting surface and overturning is impossible.

However, different conditions prevail if the road surface in question is substantially horizontal or, as viewed from the vehicle, is inclined in the direction of the car jack.

In such cases, the necessary stability of the stand column when in the approximately vertical position is not assured. If, in the case of an e.g. approximately horizontal road surface, transverse forces appear which act in the direction of the car jack, caused for example by the wind or by a person leaning against the body of the raised vehicle, then under the effect of these transverse forces by a corresponding tilt of the stand column the position of the carrier arm relative to the stand column will change. This means that the abutting surface of the carrier arm separates from the bearing surface provided e.g. on the stand column, whereby an unstable lever system is created between these parts of the car jack, so that the latter can not oppose any appreciable moment of resistance to such transverse forces, thus giving rise to the possibility of a downward slipping off of the car or of an overturning of the stand column.

This danger is present to a greater extent where particularly rigid, self-supporting vehicle bodies are concerned. In this case, it may happen that the vehicle in question, in the raised state, is in firm contact with the ground only by the wheel located diagonally opposite to the receiving body socket used for lifting. The unstable behaviour of such vehicles in the raised state then considerably increases the danger of overturning of the stand column.

SUMMARY OF THE INVENTION

According to the invention, there is provided a car jack comprising a base, a stand column supported on the base, a carrier arm adjustable in elevation and having pivotably arranged thereon an insertion shaft, a threaded spindle mounted pivotably but axially immovable on the stand column, and a threaded nut serving for elevation adjustment of the carrier arm and being guided on the spindle, the carrier arm having an abutting surface which, beyond a certain lifting position, bears against a bearing surface provided on the stand column or on the threaded nut, the base of the stand column being arranged, when the insertion shaft of the carrier arm is inserted into a receiving socket of a vehicle body, to bear on a supporting surface at the side thereof which faces away from the carrier arm at a radial distance relative to the axis of the stand column.

In a preferred car jack, by means of the stand base support which bears on the supporting surface and which is provided on the stand column side facing away from the carrier arm and which is laterally offset relative to the stand column, it is achieved that, on the stand column, starting from its position of application and up to its maximum supporting position, a pitching moment is effective at all times which tends to tilt the stand column in the direction of the vehicle to be raised. This moment of force effects that the carrier arm, especially in the maximum, i.e. substantially vertical bearing position of the stand column, is forcibly pressed with its abutting surface on the associated bearing surface of the stand column, so that the danger of overturning of the stand column is substantially avoided. Here, it is essential that this pitching moment is also effective when the supporting surface of the car jack is inclined as viewed from the vehicle in the direction of the stand column.

Preferably, the base comprises a plate which, for the purposes of unilateral support, has at least one protrusion on its underside. In this case, the desired positional safety of the car jack may be achieved by arranging that the stand column be inclined by approximately 2° when the base plate is in full contact with the supporting surface.

At least one protrusion may be provided to supply the pitching moment, and may be variously constructed. The protrusion may be of elongate form and extends perpendicular to the carrier arm. Thus, the protrusion may be formed on to the plate. Alternatively, the protrusion may be constituted by at least one rib-like molding made of rubber or plastics fastened to the underside of the base plate.

The protrusion may be constituted by at least one corrugation formed in the base plate or by a claw pressed out of the base plate. In this context, the claw may be constituted by a stud-shaped portion of the base plate. By this means, a troubleproof support may be provided, even in the case of a relatively hard ground surface.

Preferably, the base plate has a slightly dished shape and a single protrusion is provided with at least its major portion on the outer face of the obliquely upwardly extending base plate. The base plate may have a rectangular or a square shape. Alternatively, the base plate may be formed as a round dish which, on its wall portion facing away from the carrier arm and drawn slightly upward, has, along an arc of circle concentric with the plate centre, three claw-shaped protrusions arranged with the outer two equi-angularly spaced from the inner one. Such an arrangement of the protrusions ensures, not only in the case of a substantially horizontal supporting surface for the car jack but also where the supporting surface is spatially inclined in two directions relative to a horizontal plane, that at all times at least two protrusions are in contact with the supporting surface and thus a safe stand of the car jack.

Preferably, on the underside of the base plate, two parallel-spaced protrusions are provided and are arranged in planes parallel to the carrier arm and symmetrically in relation thereto, the two protrusions increasing in height in the direction of the side of the base plate which faces away from the carrier arm.

Preferably, the protrusions are wedge shaped and are formed by corrugations.

Preferably, the protrusion extends in a plane parallel to the pivot axis of the carrier arm and is concavely curved symmetrically relative to the longitudinal axis of the stand column.

Preferably, the base plate is constituted by an angle plate, and the wall portions of the protrusion formed by a corrugation interconnect the angle sides of which one is located underneath and the other on the side of the stand column.

The base plate may be arranged relative to the stand column at an angle $\alpha$ deviating from 90°. In this case, the provision of one or several protrusions on the base plate can be dispensed with because, owing to the oblique orientation of the base plate, the base plate will contact the supporting surface only with an edge portion when the car jack is applied.

Preferably, the base plate has a slightly dished shape, and on its slightly upward curving wall portion facing away from the carrier arm has, located along an arc of circle concentric with the plate centre, three claw-shaped protrusions with the outer protrusions spaced at equal angular distances from the inner protrusion, there being provided on the wall portion located diametrally opposite to the wall portion carrying the said protrusions the same number of protrusions having the same construction and spacing.

Preferably, the stand column on the lower end of its side facing away from the carrier arm is connected to an element of a joint, the other element of which is arranged on the base plate. Advantageously, a conventional jointed base having a ball joint can be employed.

BRIEF DESCRIPTION OF THE DRAWING

The invention will be further described, by way of example, with reference to the accompanying drawings, in which:

FIG. 2 is a plan view of the car jack of FIG. 1;

FIG. 3 is a view of the lower end portion of the stand column, provided with a base plate, as seen in the direction of arrow A in FIG. 1;

FIG. 4 shows a second example of embodiment of a car jack base in side elevation;

DETAILED DESCRIPTION

Figure 1:
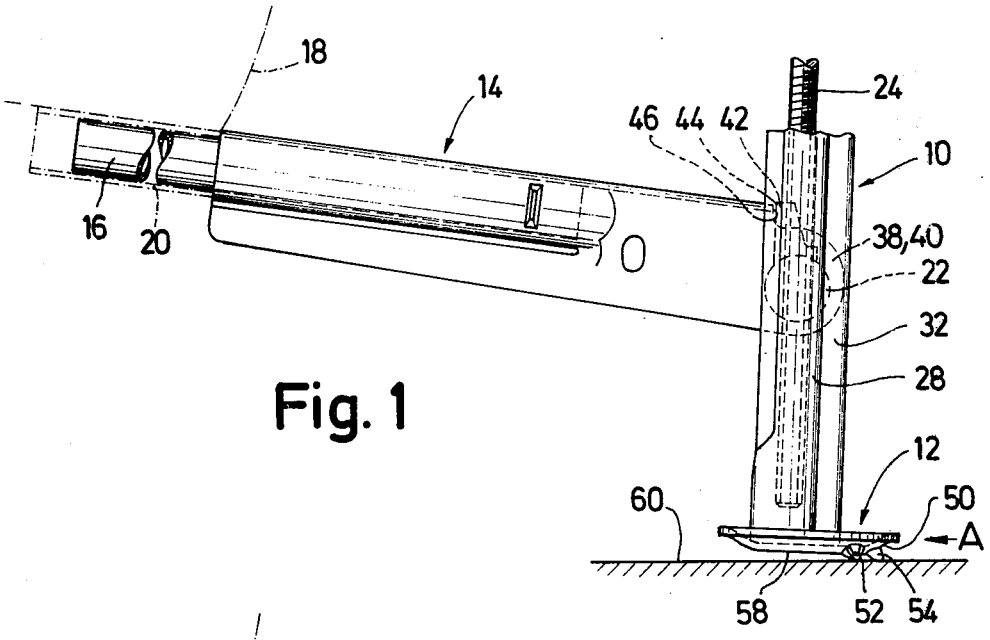
FIG. 1 shows a side jack, the stand column of which has a first exemplary embodiment of a base plate, the carrier arm being located in its lowermost position of application.

The drawing illustrates various possible examples of embodiment of base structure of the stand column of a car jack, with the aid of which, when such a car jack is applied, a pitching moment can be generated, owing to which the carrier arm, beyond a certain lifting position of the stand column, is applied under pressure with an abutting surface against the bearing surface of the stand column, whereby a braced association of stand column and carrier arm is achieved.

The car jack shown in FIG. 1 has a stand column or number 10 which on its lower end carries a base plate 12. Reference 14 designates a carrier arm, from the front end of which an insertion shaft 16 projects outwardly, which insertion shaft can be engaged into one of several receiving sockets provided on the underside of a motor vehicle body 18. The receiving sockets may be constituted for example by pipe segments 20.

The carrier arm projects with its rear end into the stand column which is open on the side facing the carrier arm, and carries on this rear end a threaded nut 22, to which the carrier arm is pivotally connected for movement in the upward or downward direction. The threaded nut is guided on a threaded spindle 24 which is rotatably mounted within, but which is supported against axial displacement relative to, the stand column and which is drivable, e.g., by means of a gear drive (not shown for the sake of simplicity), provided on the upper end of the stand column, operated in turn by means of a hand crank.

FIG. 2 shows the open cross-section of the stand column. This figure also shows that the threaded nut 22 is at the same time also guided in corresponding, corrugation-shaped guides 26, 28 of the side walls 30, 32 of the stand column and in the longitudinal direction thereof, to which end the threaded nut carries on the front side corresponding integral bearing profiles 34,36 which extend within the guides 26,28 with form locking effect.

FIG. 2 shows that the rear end of the carrier arm is mounted by means of two bearing eyelets 38, 40 on the threaded nut which, in a known manner, is fitted e.g. with a stop dog 42 which, applying on the threaded spindle, partly surrounds the latter and has a bearing surface 44 against which an abutting surface 46 provided on the rear end of the carrier arm comes to bear beyond a certain lifting position of the carrier arm. The car jack construction described so far is already known per se.

In the following, possible examples of embodiments of the stand base of the car jack will be described with reference to the various figures.

Figure 1A:
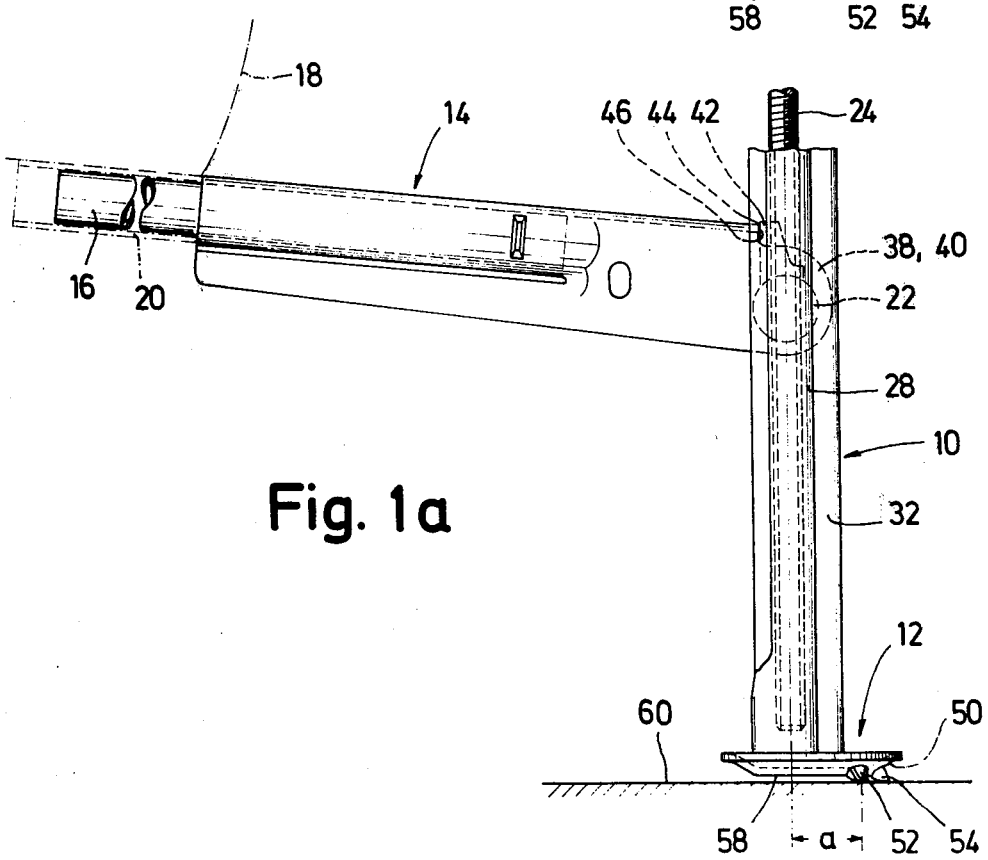
FIG. 1*a* is an illustration similar to FIG. 1, in which the carrier arm is located in an intermediate lift position.

In the construction according to FIG. 1, the stand base is constituted by the base plate 12, which has for example the shape of a slightly dished disc. On the outside of an obliquely upwardly extending base plate portion 50, which is at a radial distance from the axis of the stand column and is located on that side thereof which faces away from the carrier arm, three claw-shaped protrusions 52, 54, 56 for example have been formed on, arranged an equal angular distance between the middle protrusion and each outside protrusion. These protrusions terminate in a substantially common plane and are distributed along an arc or circle concentric to the centre of the plate. Their construction is such that they project from the face 58 of the preferably plane underside of the plate. As can be clearly seen in FIGS. 1 and 1a, the claw-shaped protrusions cause the plate portion of the base plate 12, above which the stand column 10 is located, to remain at a distance above the support surface 60 when the stand column assumes a substantially vertical support position. By means of this eccentric support of the stand column, in particular on its side facing away from the carrier arm, a lever effect of a simple lever of length a is achieved, thus generating a pitching moment which, from the very beginning of the raising operation, will at all times tend to tilt the stand column in the direction of the vehicle body.

It is ensured hereby that transverse forces acting on the vehicle body in a direction away from the latter towards the stand column cannot lead to an overturning of the stand column according to FIG. 1 in clockwise direction, and thus to an accidental slipping off of the vehicle. In the course of the raising movement, the stand column which, for engagement of the insertion shaft 16 into a receiving socket of the vehicle body, has to be set up in a correspondingly oblique position, executes a continuous pivoting movement in the direction of the vehicle body, so that finally the abutting surface 46 provided on the rear end of the carrier arm comes to rest against the bearing surface 44 of the stop 42 of the threaded nut. Here, the active pitching moment generated by the protrusions 52, 54, 56 ensures that these surfaces 44, 46 then bear on each other with pressure at all times, in particular also when the positioning surface, for example, has a downward inclination in the direction of the stand column as viewed from the vehicle body. It is thus ensured not only in the case of a substantially horizontal positioning surface but also where the car is to be raised from a positioning surface having a negative inclination that the stand column is prevented from executing any pivotal movements relative to the carrier arm caused by transverse forces acting on the vehicle body in the direction of the stand column. The car jack is thus distinguished by an optimum positional stability, and this also applies, owing to the special arrangement of the claw-shaped protrusions along a concentric arc of circle on the base plate, when the supporting surface 60 is inclined in two directions relative to a horizontal plane. This condition is illustrated in FIG. 3, where it is to be assumed that the obliquely oriented surface 60 has an additional downward inclination to the rear of the projection of the jack base shown in FIG. 3. The above described arrangement of the protrusions ensures in this case that the base plate contacts the surface 60 inclined in two directions with at least two protrusions at all times.

In the example of embodiment according to FIG. 4, the stand column base is similarly constituted by a slightly dished base plate 62, which is arranged at the lower end of stand column 10 and, relative to the longitudinal axis of the latter, at an angle deviating from 90°. This angle, referenced $\alpha$, is preferably of 88°. The advantage of this construction is that a base plate already known per se can be employed, which may have on each of diametrally opposite, slightly upwardly curving wall portions 64, 66 preferably three claw-shaped protrusions arranged with the outer two spaced at equal angular distances from the inner one, where the one wall portion 64 equipped with protrusions is located on that side of the stand column which faces away from the carrier arm, so that its protrusions provide for unilateral support of the stand column during application and raising of the vehicle.

Figure 5:
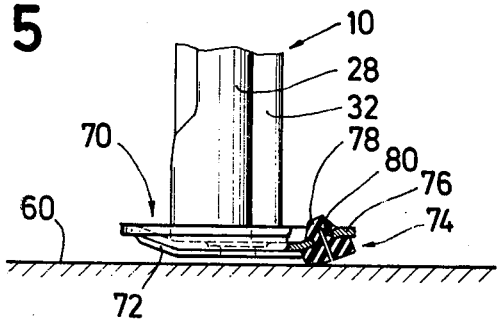
FIG. 5 shows a third example of embodiment of a car jack base in side elevation and partial section.
Figure 6:
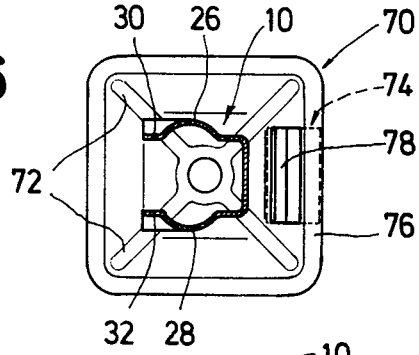
FIG. 6 is a plan view of the car jack base of FIG. 5.

In the example of embodiment shown in FIGS. 5 and 6, reference 70 designates a base plate arranged perpendicular to the longitudinal axis of stand column 10. This base plate is for example square shaped and is again slightly dished. For reinforcing purposes, this base plate has preferably diagonally extending reinforcing corrugations 72 rising from the underside of the plate. The unilateral support of the stand column is provided by a rib-like projection 74, which extends on the plate side facing away from the carrier arm and parallel to a plate edge portion 76 and is located between two corrugations 72. This rib-like projection is constituted for example by a molding made of a relatively hard rubber, which on its upper face has an elongate expander prong 78 which engages through a fastening slot 80 of the base plate and is supported on the upper face thereof. This rib-like projection 74 can equally well be constituted by a molding made of a suitable synthetic plastics material.

Figure 7:
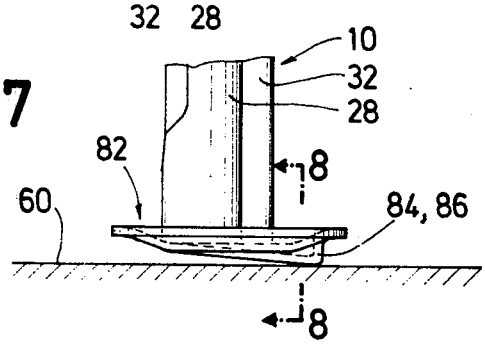
FIG. 7 shows a fourth example of embodiment of a car jack base in side elevation.
Figure 8:
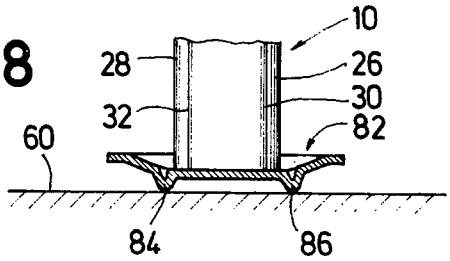
FIG. 8 is a partial section through the car jack base in FIG. 7, taken along the line 8—8.

FIGS. 7 and 8 show an example of embodiment of a likewise slightly dished base plate 82, which on its underside has two parallel spaced rib-like projections 84, 86 arranged in planes parallel to the carrier arm and symmetrically relative to the latter. As FIG. 7 shows, these projections increase in size in the direction of a plate edge which, in analogy with FIG. 1, is located on the side facing away from the carrier arm. The two rib-like projections thus constitute wedges formed out of the underside of the plate, and are constituted preferably by corrugations pressed into the floor portion of the base plate. These corrugations likewise provide the unilateral support of the stand column 10 which is necessary for generating the pitching moment.

Figure 9:
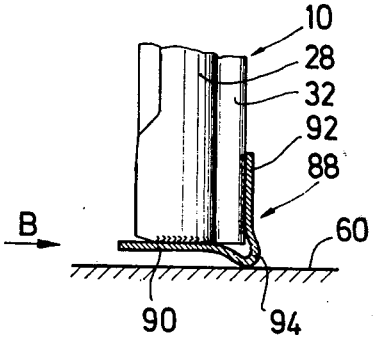
FIG. 9 shows a side elevation of a fifth example of embodiment of a car jack base.
Figure 10:
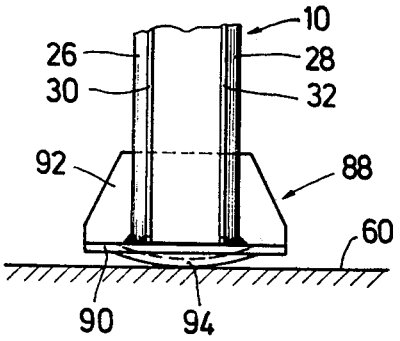
FIG. 10 is a view of the car jack base according to FIG. 9, as seen in the direction of arrow B in FIG. 9.

FIGS. 9 and 10 show a simplified mode of construction of the base plate 88, which is constituted by an angle plate, one arm 90 of which is fastened to the underside of the stand column, whilst the other arm 92 bears on the longitudinal side of the stand column which faces away from the carrier arm. In their transition zone, the two sides form a downward protruding corrugation 94, which extends in a plane parallel to the pivot axis of the carrier arm. This corrugation can form a supporting edge which, as viewed perpendicularly to the plane of the drawing, is formed in a straight line. However, it will preferably have the construction shown in FIG. 10, where it can be seen that the corrugation 94 is concavely curved symmetrically to the longitudinal axis of the stand column.

Figure 11:
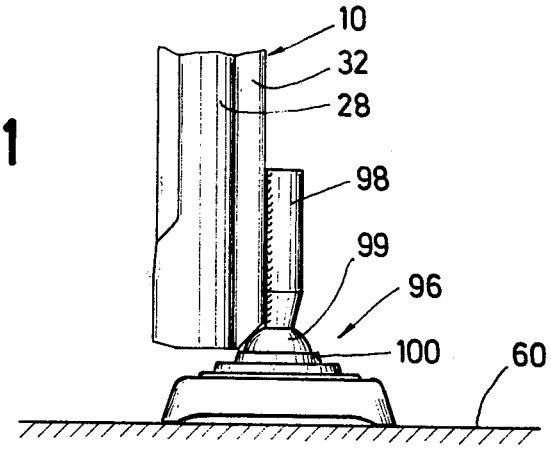
FIG. 11 shows a side elevation of a sixth form of embodiment of a car jack base.

Lastly, FIG. 11 shows a mode of construction in which the stand column base is constituted by a jointed base plate generally referenced 96. This has a journal 98 with a ball head 99, which is pivotable in all directions in a trough 100.

For unilateral support of the stand column 10, the journal 98 is fastened, for example by welding, to that side of the stand column which faces away from the carrier arm.

I claim:

1. In a car jack apparatus for elevating a vehicle body relative to a supporting surface, including a base member; a generally vertical hollow stand member connected at its lower end with said base member, said stand member containing a vertical slot affording access to the interior of the stand member; a nut member guided for vertical displacement within said stand member; a carrier arm connected at one end with said nut member for pivotal movement about a horizontal pivot axis between generally horizontal operable and generally vertical downwardly extending collapsed positions, respectively, said nut member and said carrier arm one end having cooperating abutting surfaces for preventing pivotal movement of said carrier arm beyond said generally horizontal operable position, said carrier arm extending horizontally through said slot for insertion at its other end within an opening contained within said vehicle body; and means including a spindle member arranged for rotation longitudinally within said stand member and threadably connected with said nut member for vertically displacing said nut member relative to said stand member;

the improvement wherein said base number (12) includes on its lower surface at least one downwardly depending projection (52, 54, 56, 58, 68, 74, 84, 86, 94) contained in a plane which contains the axes of both said carrier arm and said stand member, each said projection being radially spaced from the axis of said stand member on the opposite side thereof from said carrier arm, thereby to cause said stand member, when said other end of the carrier arm is inserted within the vehicle body opening and said spindle is rotated to vertically displace said nut member relative to said stand member, to be tilted about said projection toward the vehicle body to a pitched orientation relative to the supporting surface.

2. A car jack apparatus as defined in claim 1, wherein said base member is arranged at an angle no greater than 88° relative to the side of said stand member adjacent said carrier arm.

3. A car jack apparatus as defined in claim 2, wherein said base member comprises a generally horizontal plate.

4. A car jack apparatus as defined in claim 3, wherein said projection comprises at least one elongated protrusion.

5. A car jack apparatus as defined in claim 4, wherein said protrusion comprises at least one rib-shaped molding formed from a synthetic material.

6. A car jack apparatus as defined in claim 5, wherein said base plate has a substantially square horizontal cross sectional configuration and further comprises a pair of downwardly depending diagonally extending corrugations.

7. A car jack apparatus as defined in claim 4, wherein said protrusion comprises at least one corrugation.

8. A car jack apparatus as defined in claim 4, wherein said base plate comprises said protrusion, said protrusion having a concave configuration symmetrically arranged relative to the axis of said stand member.

9. A car jack apparatus as defined in claim 8, wherein said base plate protrusion comprises an angle plate, one wall portion of said angle plate extending beneath said stand member, the other wall portion said angle plate extending up the side of said stand column opposite said carrier arm.

10. A car jack apparatus as defined in claim 3, wherein said projection comprises a generally claw-shaped protrusion.

11. A car jack apparatus as defined in claim 10, wherein said claw-shaped protrusion comprises a stud-shaped portion integrally arranged with said base plate.

12. A car jack apparatus as defined in claim 11, wherein said base plate has a circular disk-shaped configuration, the portion of said plate opposite said carrier arm being drawn upwardly and including said claw-shaped protrusion, said claw-shaped protrusion comprising three stud portions arranged along an arc of a circle concentric with the center of said base plate, the outer two of said stud portions being equiangularly spaced from the inner one thereof.

13. A car jack apparatus as defined in claim 3, wherein said base plate has a disk-shaped configuration, and further wherein a single protrusion is provided on the outer portion thereof.

14. A car jack apparatus as defined in claim 3, wherein said at least one projection comprises a pair of parallel, spaced, elongated protrusions arranged in planes parallel and symmetric relative to said carrier arm, said pair of protrusions increasing in depth in the direction of the side of said base plate opposite said carrier arm.

15. A car jack apparatus as defined in claim 14, wherein said pair of protrusions are wedge-shaped and comprise a pair of corrugations.

16. A car jack apparatus as defined in claim 1, wherein said base member is arranged at an angle less than 90° relative to the side of said stand member adjacent said carrier arm.

17. A car jack apparatus as defined in claim 16, wherein (1) said base member has a circular disk-shaped configuration;

(2) a first portion of said base member opposite said carrier arm being drawn upwardly; and (3) said projection includes two groups of claw-shaped protrusions, each of said sets including three protrusions respectively, one of said groups being arranged along said base member first portion along a circular arc concentric with the center of said base member, the other of said groups being arranged along a second portion of said base member opposite said first portion, the outer protrusions of each of said groups being spaced at equal angular distances from the inner protrusion of each of said groups, respectively.

18. A car jack apparatus as defined in claim 1, and further including ball joint means for connecting said base member with said stand member.

* * * * *